US006499148B2

(12) United States Patent
Chou

(10) Patent No.: US 6,499,148 B2
(45) **Date of Patent: *Dec. 31, 2002**

(54) SWIMMING GOGGLES WITH IMPROVED WEARING COMFORT AND PULLING RESISTANCE

(76) Inventor: Terry Chou, No. 12, Hsin Ho Herng Road, Tainan City (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/840,162

(22) Filed: Apr. 24, 2001

(65) Prior Publication Data

US 2002/0152543 A1 Oct. 24, 2002

(51) Int. Cl.[7] ..... A61F 9/02
(52) U.S. Cl. ..... 2/428
(58) Field of Search ..... 2/428, 441, 440, 2/426, 445, 452, 443

(56) References Cited

U.S. PATENT DOCUMENTS 5,950,248 A * 9/1999 Kawashima et al. ..... 2/441
6,052,834 A * 4/2000 Chou ..... 2/428
6,079,054 A * 6/2000 Chou ..... 2/428
6,098,206 A * 8/2000 Chou ..... 2/428
6,119,277 A * 9/2000 Chiang ..... 2/428

* cited by examiner

*Primary Examiner*—John J. Calvert
*Assistant Examiner*—Katherine Moran
(74) *Attorney, Agent, or Firm*—Rosenberg, Klein & Lee

(57) ABSTRACT

A pair of swimming goggles comprises two lenses, two frames, a bridge, two padding members, and a head strap. Each lens is made of rigid material and includes an engaging portion. Each frame receives an associated lens therein and has an engaging portion engaged with the head strap. The bridge is integrally formed with the frames and located between the frames. Each padding member is made of a flexible material that is softer than that of the frames. Each padding member has a receiving portion for securely engaging with the engaging portion of the associated lens. Each padding member includes a padding portion in intimate contact with a wearer's eye socket.

2 Claims, 10 Drawing Sheets

SWIMMING GOGGLES WITH IMPROVED WEARING COMFORT AND PULLING RESISTANCE

BACKGROUND OF THE INVENTION

1. Field of the Invention

The present invention relates to a pair of swimming goggles that is aesthetically pleasing, easy to assemble, and improved in application, wearing comfort, supporting effect, and pulling resistance.

2. Description of the Related Art

FIG. 6 of the drawings illustrates a pair of conventional swimming goggles that includes two lenses 1', two padding members 2', a bridge 3', and a head strap 4'. Each lens 1' is made of a transparent rigid material and includes a first connecting portion 12' on an inner end thereof for engaging with the bridge 3' and a second connecting portion 13' on an outer end thereof for engaging with the head strap 4'. Each padding member 2' is made of a soft material and includes a tensile engaging portion 21' on an outer side thereof for engaging with a flange 11' of an associated lens 1'. Each padding member 2' further includes a padding portion 22' on an inner side thereof for intimate contact with the eye socket of a wearer. The bridge 3' is made from a slightly flexible material and is thus bendable. The padding members 2' can be in contact with the eye sockets of various wearers. However, the lenses 1' and the bridge 3' are separate from each other and thus fail to provide an overall aesthetically pleasing effect.

FIGS. 7 and 8 illustrate another pair of conventional swimming goggles comprising two lenses 5', two frames 6', a bridge 7', and a head strap 8'. Each lens 5' is made of a transparent rigid material and includes a connecting edge 51' for engaging with an associated frame 6'. The frames 6' and the bridge 7' are integrally formed from a soft material. Each frame 6' includes a padding portion 61' for intimate contact with a wearer's eye socket, an engaging portion 62' for engaging with the head strap 8', and an annular receiving portion 63' for receiving an associated lens 5'. The annular receiving portion 63' is made of a soft material and is tensile and thus can be pulled for engaging with the connecting edge 51' of the associated lens 5'. The frames 6' and the bridge 7' are integral and thus provide a better appearance. The frames 6' can be in intimate contact with the eye sockets of various wearers due to the soft material of the bridge 7'. However, it was found that the frames 6' and the bridge 7' are too soft and thus tend to deform and fail to support the lenses 5' if the material of the frames 6' and the bridge 7' is identical to that of the padding members 61'. If a harder material is chosen for manufacturing the frames 6', the bridge 7', and the padding members 61', the resultant padding members 61' would be too hard to the wearer's eye sockets. In addition, as illustrated in FIG. 9, when the head strap 8' is pulled rearwards, the frames 6' will extend laterally outward, which causes large inward deformation and thus discomforts the wearer's nose.

FIG. 10 illustrates a further pair of conventional swimming goggles that comprises two lenses 91', two frames 92', a bridge 93', two padding members 94', and a head strap 95'. Each lens 91 ' is made of a rigid material and includes an engaging hole 911 ' in a side thereof. The frames 92' and the bridge 93' are integrally formed by rigid material. Each frame 92' includes a protrusion 921' for engaging with the engaging hole 911' of an associated lens 91'. Each padding member 94' is made of soft material and includes a receiving portion 941' for engaging with an associated lens 91' by means of tensilibility of the padding member 94'. The bridge 93' is made of a rigid material and is thus not easy to deform such that the padding member 94' cannot be exactly in intimate contact with the eye sockets of the wearer. In addition, the rigid bridge 93' and the frames 92' tend to break when impinged, which might cause injury to the wearer.

SUMMARY OF THE INVENTION

It is the primary object of the present invention to provide a pair of swimming goggles that is aesthetically pleasing, easy to assemble, and improved in application, wearing comfort, supporting effect, and pulling resistance.

A pair of swimming goggles in accordance with the present invention comprises:

- two lenses made of rigid material and each including an engaging portion;
- two frames each for receiving an associated said lens therein, each said frame having an engaging portion;
- a bridge integrally formed with the frames and located between the frames, the frames and the bridge being integrally formed from a material that is slightly flexible and has a supporting ability;
- two padding members made of a flexible material that is softer than that of the frames, each said padding member having a receiving portion for securely engaging with the engaging portion of the associated lens, each said padding member including a padding portion in intimate contact with a wearer's eye socket; and
- a head strap engaging with the engaging portion of the frames.

The padding members may be integrally formed.

Thus, the pair of swimming goggles in accordance with the present invention provides an aesthetically pleasing effect. The bridge and the frames can be deformed to be intimate contact with the wearer's eye sockets during wearing. In addition, the frames and the bridge will not deform to a large extent when the head strap is pulled. The soft padding portion of each padding member is in intimate contact with the wearer's eye socket and thus provides improved wearing comfort.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
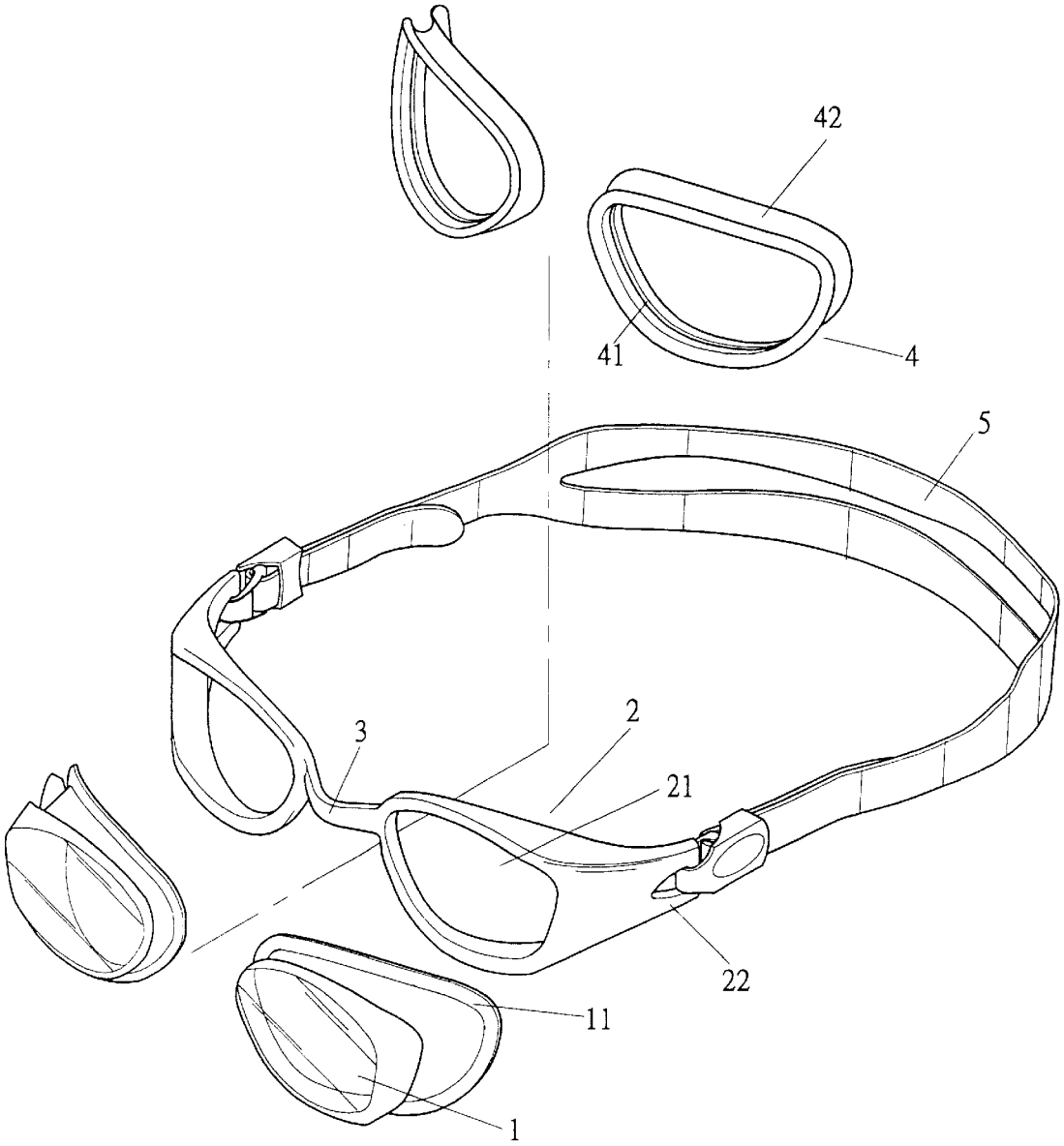
FIG. 1 is a perspective view of a pair of swimming goggles in accordance with the present invention.
Figure 2:
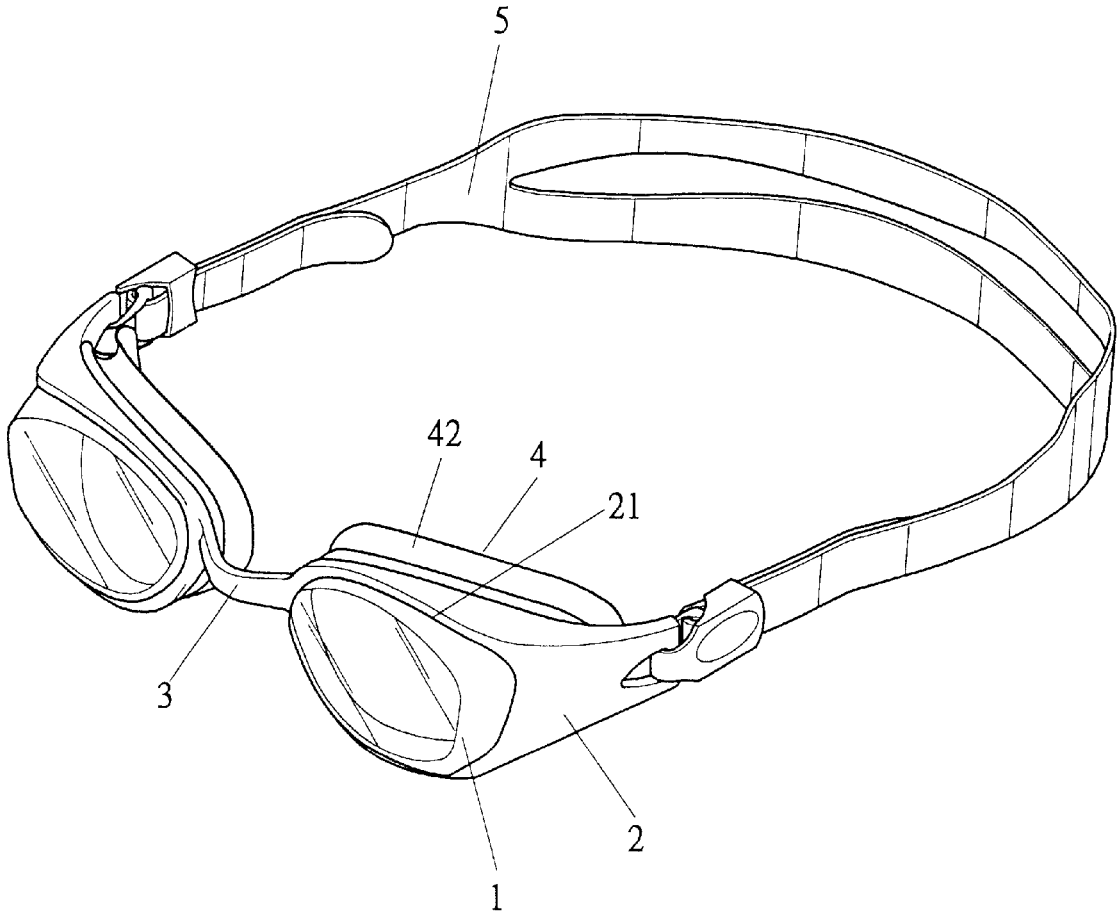
FIG. 2 is a perspective view of the pair of swimming goggles in FIG. 1.

Referring to FIGS. 1 through 5 and initially to FIGS. 1 and 2, a pair of swimming goggles in accordance with the present invention generally includes two lenses 1, two frames 2, a bridge 3, two padding members 4, and a head strap 5. Each lens 1 is made of rigid material and includes an engaging portion 11 (in the form of an annular flange in this embodiment) for engaging with an associated padding member 4.

The frames 2 and the bridge 3 are integrally formed from a material that is slightly flexible and has a certain supporting ability. Each lens 1 is mounted in a compartment 21 in an associated frame 2 by means of tensilibility of the frame 2. Each frame 2 includes an engaging portion 22 for engaging with the head strap 5. The integral design of the frames 2 and the bridge 3 provides an overall aesthetically pleasing effect.

Each padding member 4 is made of a flexible material that is softer than that of the frames 2. Each padding member 4 includes a receiving portion 41 for engaging with the engaging portion 11 of an associated lens 1. Each padding member 4 further includes a padding portion 42 for intimate contact with the Wearer's eye socket.

Figure 3:
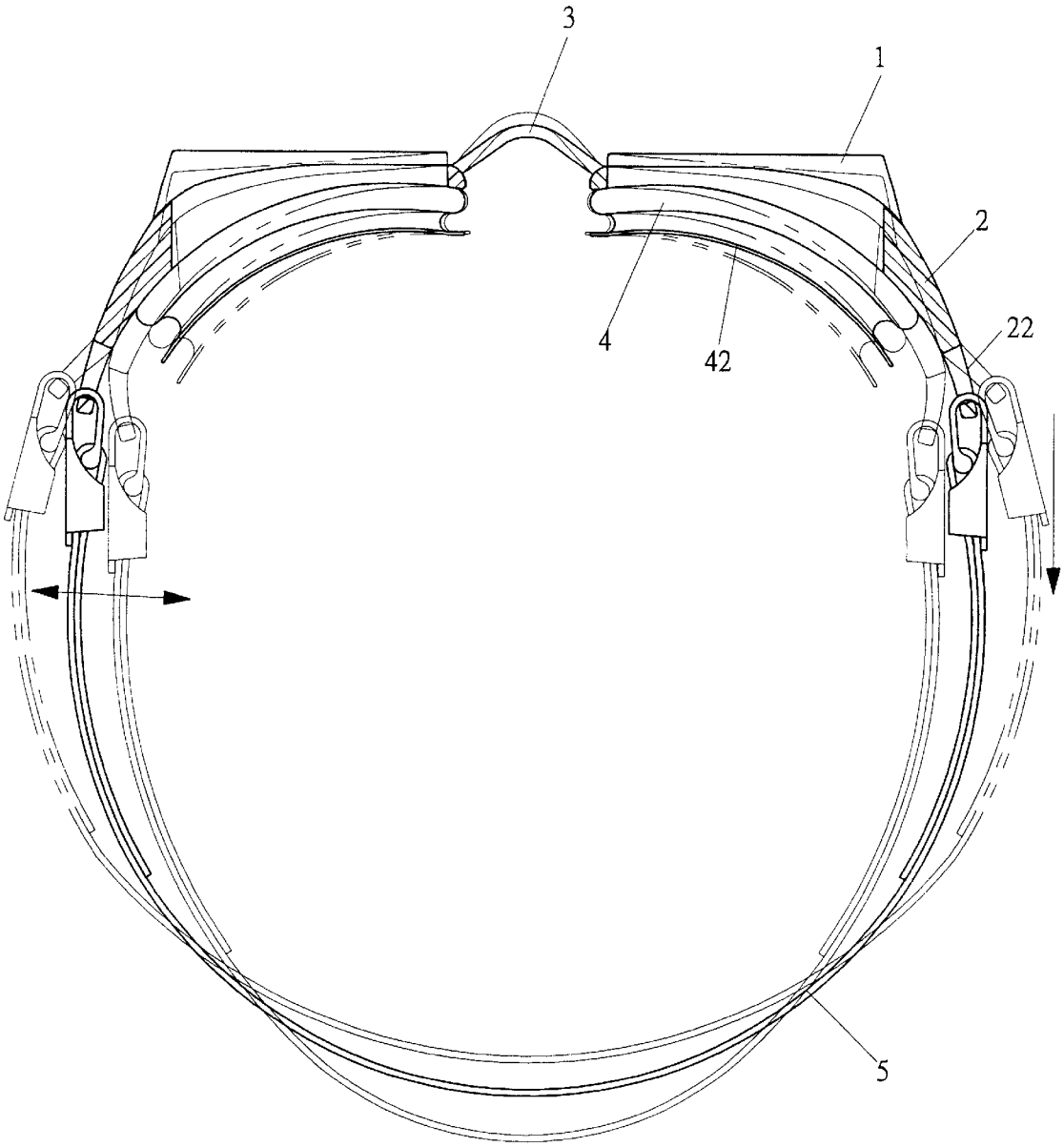
FIG. 3 is a top view, partly sectioned, of the pair of swimming goggles in FIG. 1.

As illustrated in FIG. 3, when in use, the flexibility of the bridge 3 and the frames 2 allow the padding members 4 to be always in intimate contact with the wearer's eye sockets. In addition, the supporting ability of the frames 2 and the bridge 3 is better than that of the padding members 4 such that the frames 2 and the bridge 1 will not deform largely. Furthermore, the intimate contact between the soft padding portions 42 of the padding members 4 and the wearer's eye sockets provides improved wearing comfort. Further, the frames 2 and the bridge 3 are flexible and thus may prevent breakage thereof when they are impinged, thereby providing improved safety.

Figure 4:
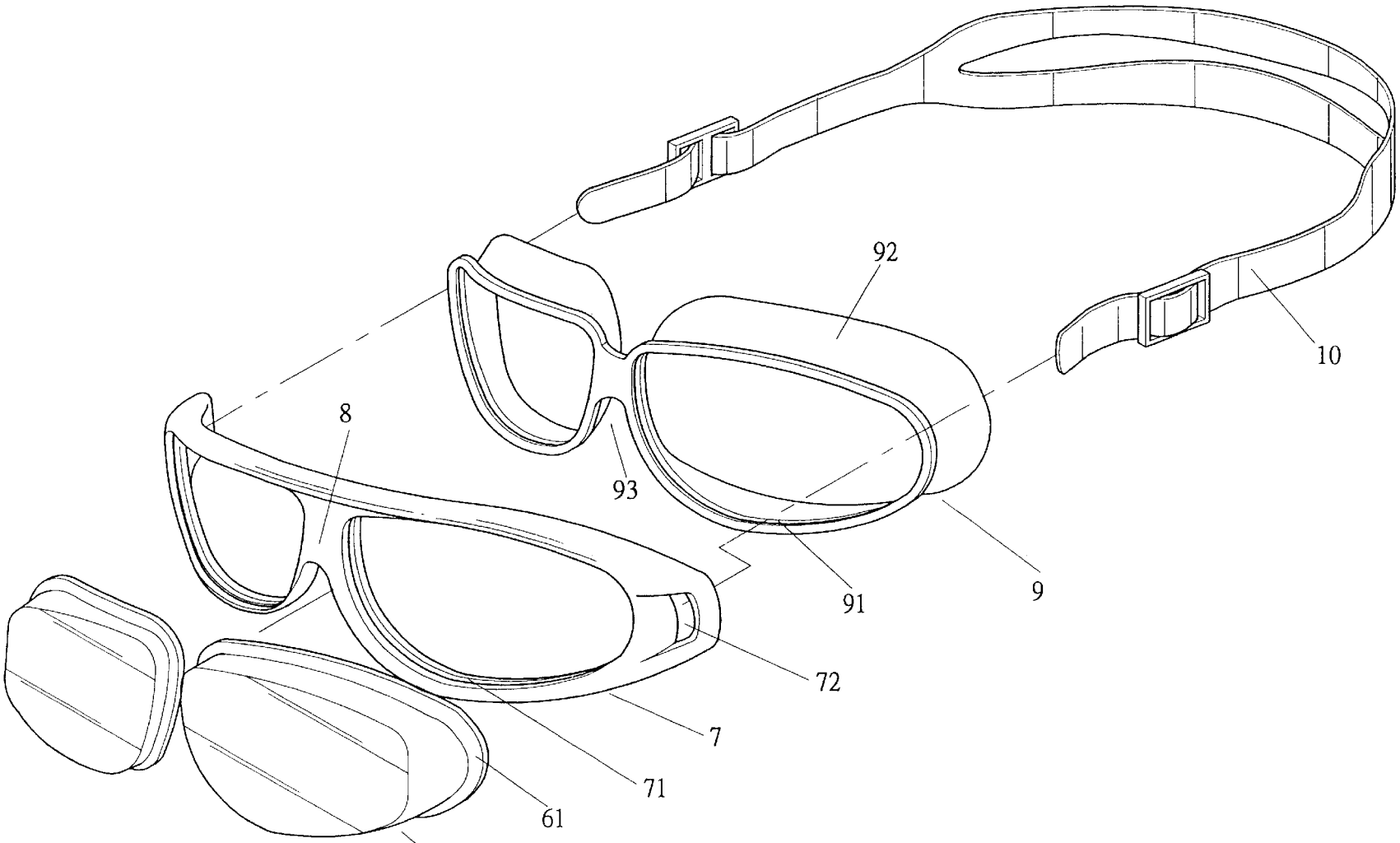
FIG. 4 is an exploded perspective view of a modified embodiment of the pair of swimming goggles in accordance with the present invention.
Figure 5:
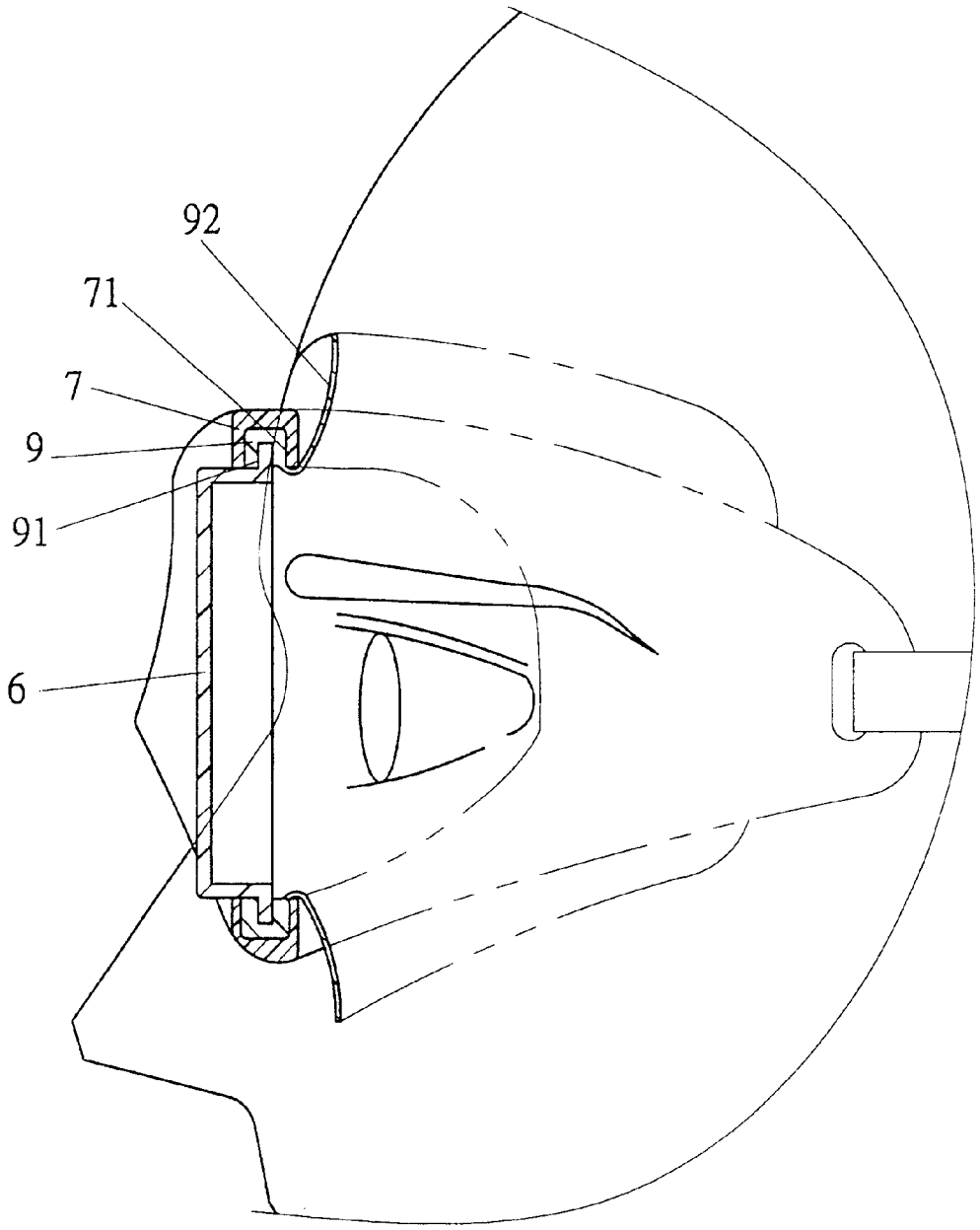
FIG. 5 is a schematic side view, partly sectioned, illustrating use of the pair of swimming goggles in FIG. 4.
Figure 6:
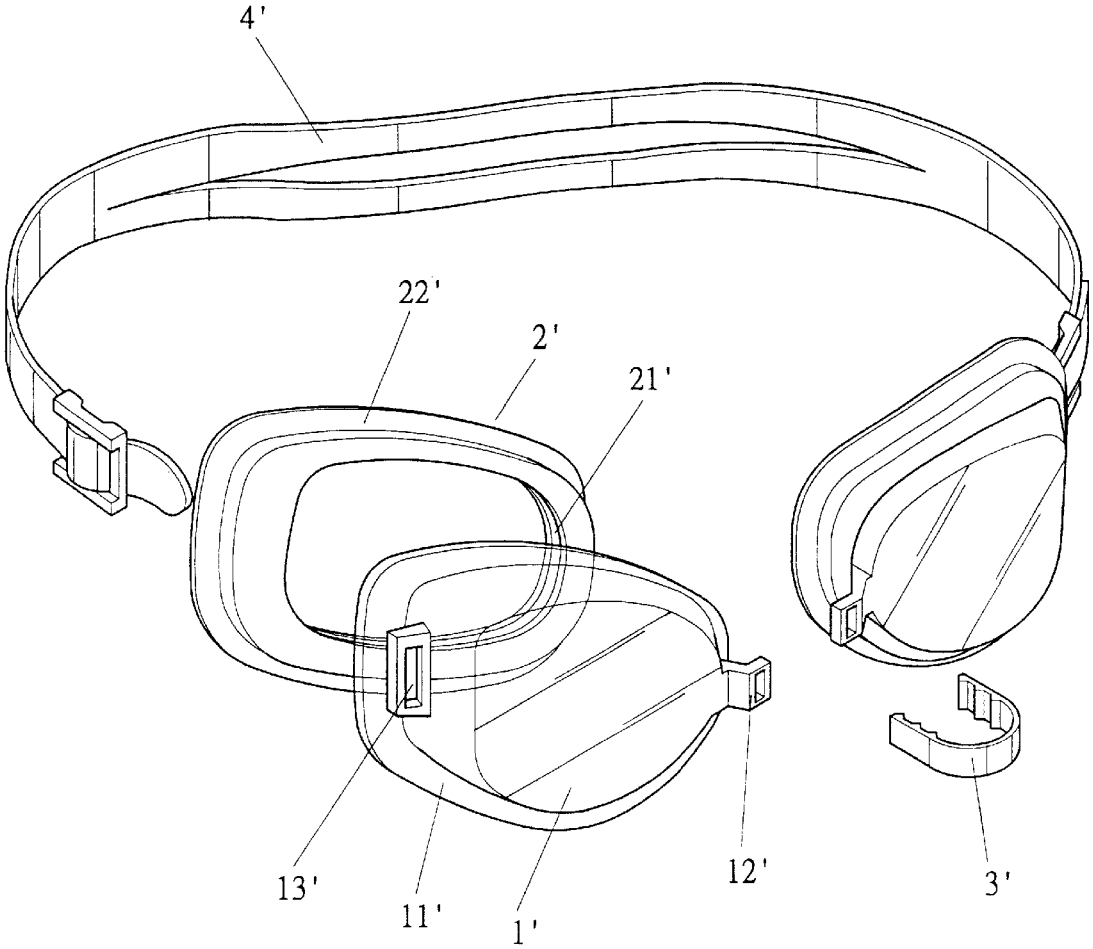
F I G . 6(PRIOR ART)
FIG. 6 is an exploded perspective view of a pair of conventional swimming goggles.
Figure 7:
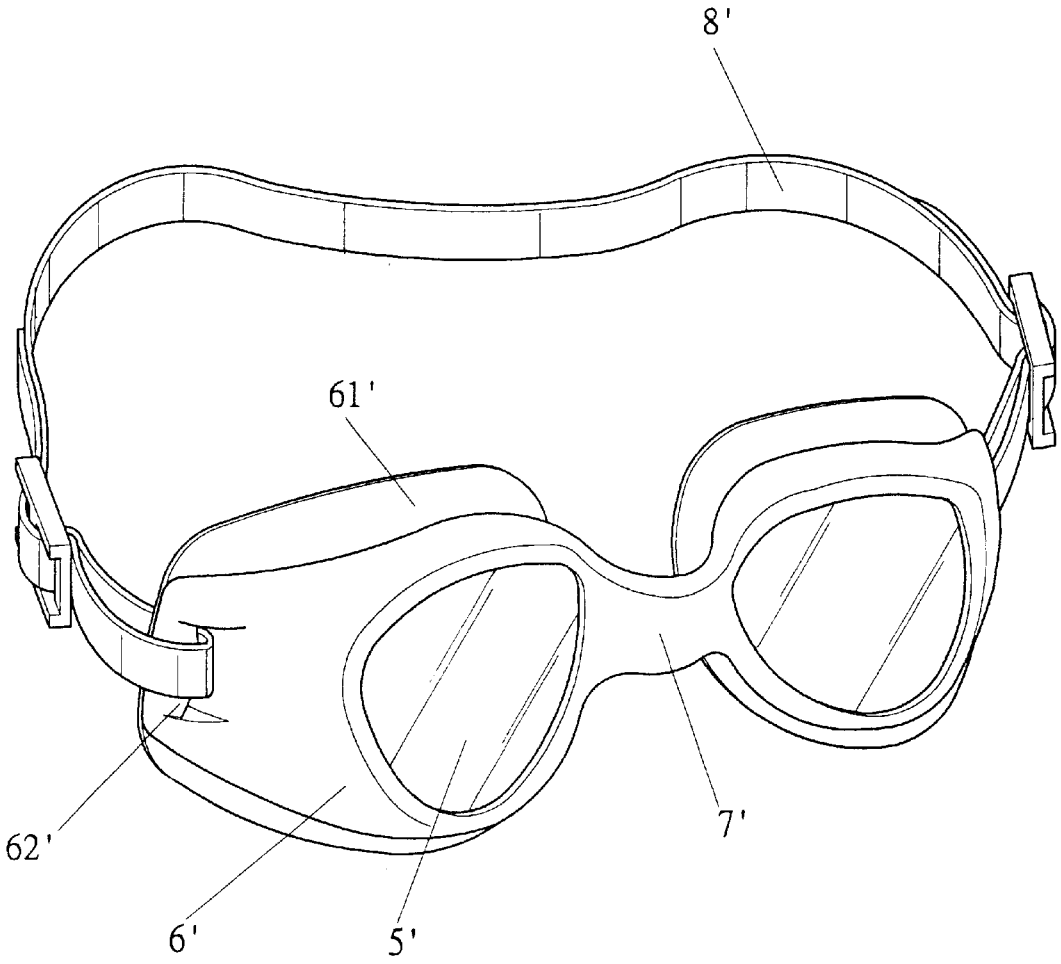
F I G . 7(PRIOR ART)
FIG. 7 is a perspective view of another pair of conventional swimming goggles.'
Figure 8:
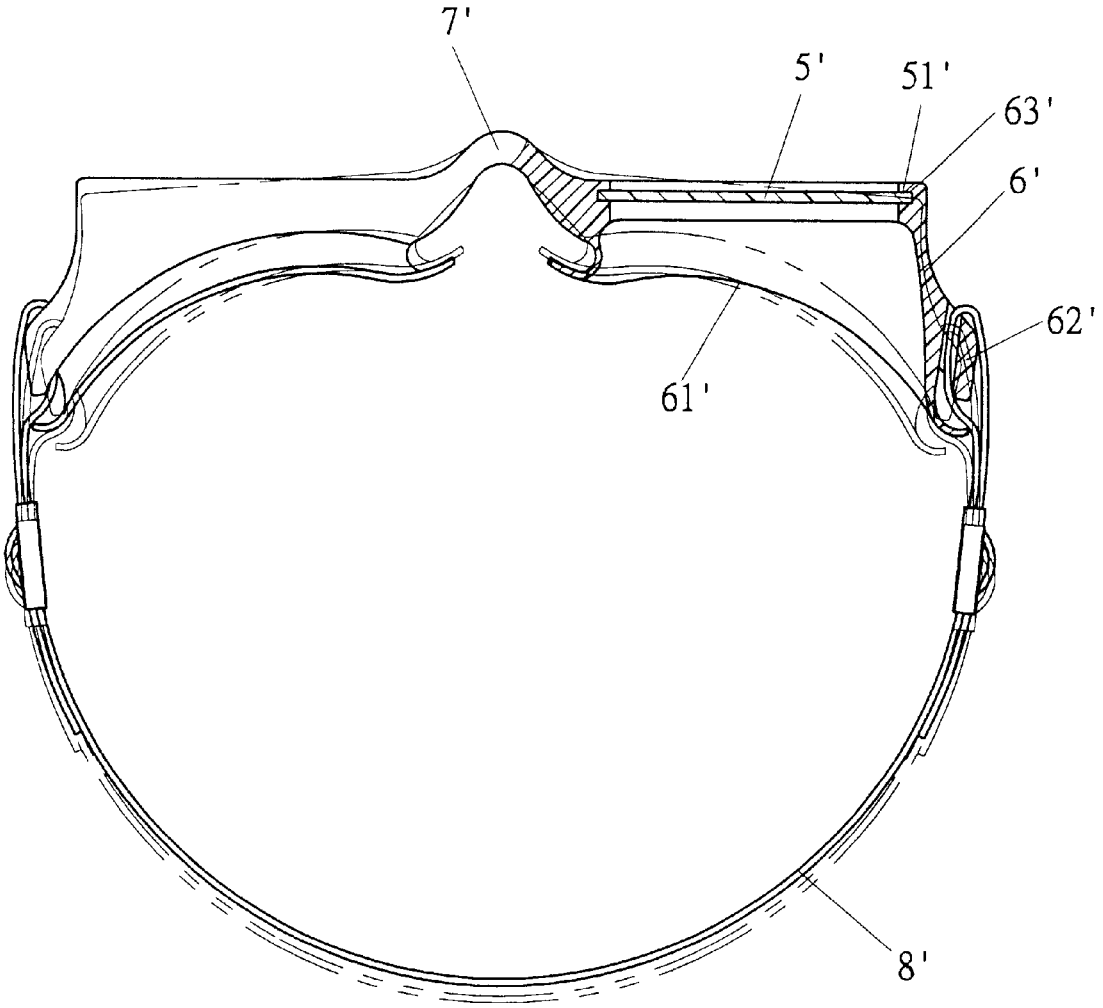
F I G . 8(PRIOR ART)
FIG. 8 is a top view, partly sectioned, of the pair of conventional swimming goggles in FIG. 7.
Figure 9:
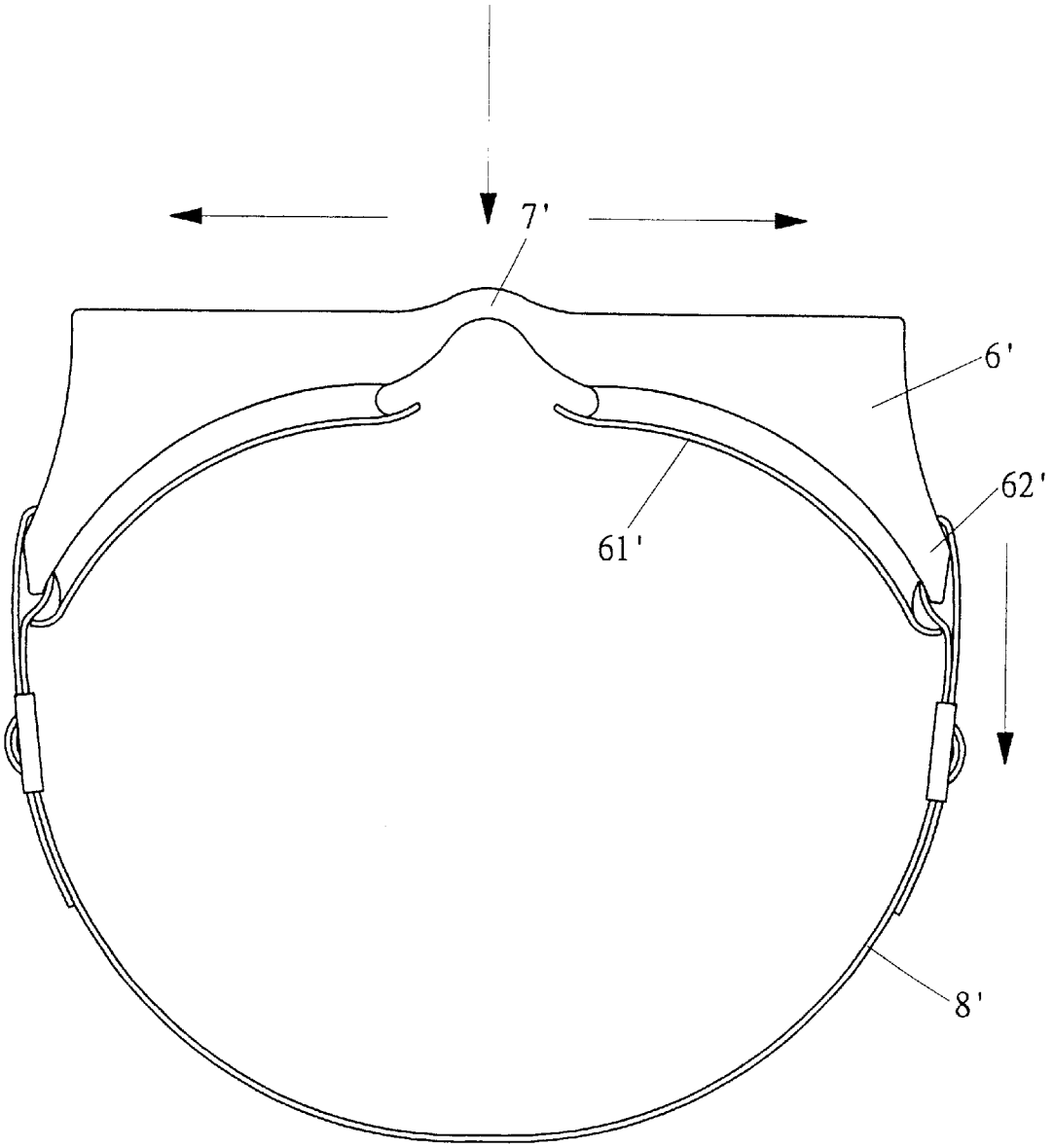
F I G . 9(PRIOR ART)
FIG. 9 is a top view of the pair of conventional swimming goggles in FIG. 8.
Figure 10:
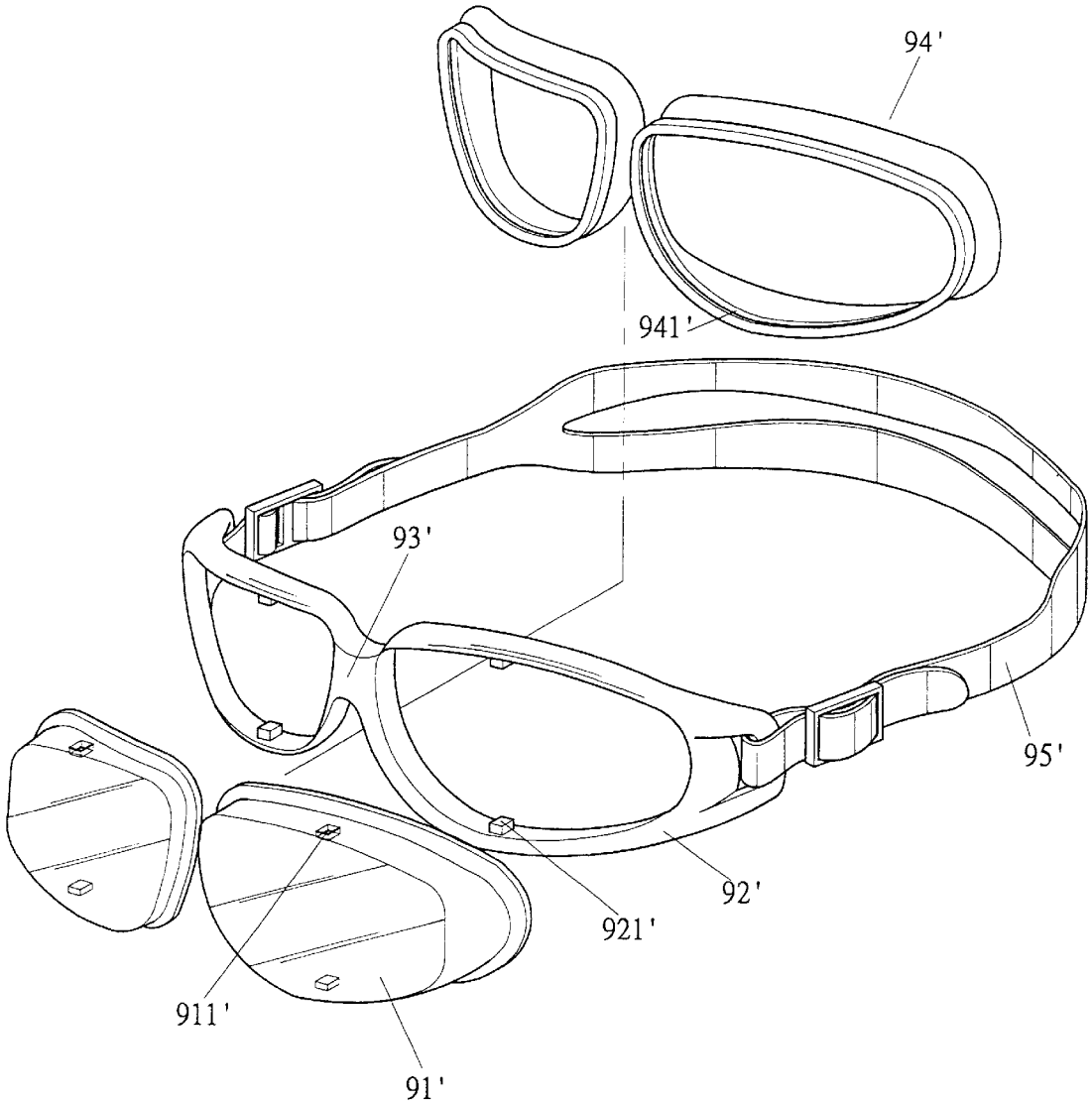
F I G . 10(PRIOR ART)
FIG. 10 is an exploded perspective view of a further pair of conventional swimming goggles.

FIGS. 4 and 5 illustrate a modified embodiment of the. pair of swimming goggles in accordance with the present invention, wherein the lenses 6 are made of rigid material and larger than human eye sockets. Each lens 6 includes an engaging portion 61 for engaging with an associated padding member 9.

The frames 7 and the bridge 8 are integrally formed from a material that is slightly flexible and has a certain supporting ability. Each lens 6 is mounted in a compartment 71 in an associated frame 7 by means of tensilibility of the frame 7. Each frame 7 includes an engaging portion 72 for engaging with the head strap 10. The integral design of the frames 7 and the bridge 8 provides an overall aesthetically pleasing effect.

Each padding member 9 is made of a flexible material that is softer than that of the frames 2. Each padding member 9 includes a receiving portion 91 for engaging with the engaging portion 61 of an associated lens 6. Each padding member 9 further includes a padding portion 92 for intimate contact with the wearer's eye socket. In this embodiment, the padding members 9 are integrally formed and connected by a connecting member 93.

It is appreciated that the pair of swimming goggles in accordance with the present invention can also be used in diving in addition to swimming.

According to the above description, it is appreciated that the flexibility of the bridge and the frames allow the padding members to be always in intimate contact with the wearer's eye sockets. In addition, the supporting ability of the frames and the bridge is better than that of the padding members such that the frames and the bridge will not deform largely. Furthermore, the .intimate contact between the soft padding portions of the padding members and the wearer's eye sockets provides improved wearing comfort. Further, the frames and the bridge are flexible and thus may prevent breakage thereof when they are impinged, thereby providing improved safety.

Although the invention has been explained in relation to its preferred embodiment, it is to be understood that many other possible modifications and variations can be made without departing from the scope of the invention as hereinafter claimed.

What is claimed is:

1. A pair of swimming goggles comprising:

two lenses made of rigid material and each including an engaging portion;

two frames each for receiving an associated said lens therein, each said frame having an engaging portion;

a bridge integrally formed with the frames and located between the frames, the frames and the bridge being integrally formed from a material that is slightly flexible and has a supporting ability;

two padding members made of a flexible material that is softer than that of the frames, each said padding member having a receiving portion for securely engaging with the engaging portion of the associated lens, each said padding member including a padding portion in intimate contact with a wearer's eye socket; and a head strap engaging with the engaging portion of the frames.

2. The pair of swimming goggles as claimed in claim 1, wherein the padding members are integrally formed.

* * * * *